US005492437A

United States Patent [19]

Ortiz

[11] Patent Number: 5,492,437

[45] Date of Patent: Feb. 20, 1996

[54] SELF-ALIGNING DEVICES AND METHODS FOR LIFTING AND SECURING STRUCTURES

[76] Inventor: Leo P. Ortiz, P.O. Box 1628, Martinez, Calif. 94553

[21] Appl. No.: 437,895

[22] Filed: May 9, 1995

[51] Int. Cl.[6] ..... E02D 7/20; E02D 27/48

[52] U.S. Cl. ..... 405/230; 52/125.1; 52/126.5; 254/29 R; 405/231; 405/232

[58] Field of Search ..... 405/231, 232, 405/230, 228; 254/29 R, 30; 52/125.1, 126.5

[56] References Cited

U.S. PATENT DOCUMENTS

| | | | |
|---|---|---|---|
| 2,982,103 | 5/1961 | Revisz et al. | 61/51 |
| 3,852,970 | 12/1974 | Cassidy | 61/51 |
| 3,992,890 | 11/1976 | Pryke | 61/50 |
| 4,434,969 | 3/1984 | Von Ruden | 254/29 R |
| 4,673,315 | 6/1987 | Shaw et al. | 405/230 |
| 4,695,203 | 9/1987 | Gregory | 405/230 |
| 4,708,528 | 11/1987 | Rippe | 405/230 |
| 4,765,777 | 8/1988 | Gregory | 405/230 |
| 4,911,580 | 3/1990 | Gregory et al. | 405/230 |
| 4,925,345 | 5/1990 | McCown, Jr. et al. | 405/232 |
| 4,955,757 | 9/1990 | Balling | 405/184 |
| 5,006,015 | 4/1991 | Stephens et al. | 405/230 |
| 5,135,335 | 8/1992 | Stephens et al. | 405/230 |
| 5,154,539 | 10/1992 | McCown, Sr. et al. | 405/230 |
| 5,205,673 | 4/1993 | Bolin et al. | 405/230 |
| 5,234,287 | 8/1993 | Rippe, Jr. | 405/230 |
| 5,246,311 | 9/1993 | West et al. | 405/230 |
| 5,253,958 | 10/1993 | Bellemare | 405/232 |
| 5,269,630 | 12/1993 | Bolin et al. | 405/230 |

*Primary Examiner*—Stephen J. Novosad
*Attorney, Agent, or Firm*—Law Office of Albert J. Dalhuisen

[57] ABSTRACT

The present invention provides novel lifting devices and methods for lifting foundations and slabs. One or more power cylinders is pivotally linked to a pier and to a foundation bracket assembly. The pivotal linkage results in self-alignment between the longitudinal axis of the pier and the axis along which compressive pressure is applied to the pier.

23 Claims, 5 Drawing Sheets

SELF-ALIGNING DEVICES AND METHODS FOR LIFTING AND SECURING STRUCTURES

FIELD OF THE INVENTION

The present invention relates to devices and methods for lifting and securing heavy objects in a raised position. More particularly, the present invention relates to devices and methods for lifting a structure such as a building by driving one or more piers into the ground and securing each pier to the structure once the structure is raised to desired level. Still more particularly, the present invention relates to self-aligning hydraulic lifting devices and methods for lifting the foundation of a structure by driving one or more piers into the ground and securing each pier to the foundation once the foundation is raised to the desired level.

BACKGROUND OF THE INVENTION

Structures such as dwellings and low rise buildings commonly do not have foundations which are in direct contact with stable load bearing underground strata, such as, for example, bedrock. Often, these structures have a footing which forms the basis upon which the foundation wall rests. The footing is usually wider than the foundation wall in order to distribute the structure's weight over a greater soil area. Alternately, a structure's foundation may consist of a floor slab. The structure 's position and stability thus depends on the stability of the underlying soil. In time, soil conditions may change, due to, for example, ground movement, ground water level changes or soil compaction. Changes in soil conditions or catastrophic events, such as, for example, earthquakes may result in highly undesirable settling of the structure, causing the structure to become uneven with the horizontal plane of the earth. Settling of the structure may result in structural damage, loss of real estate value and major inconvenience to the user of the structure.

Various devices and methods have been developed to raise and support a structure such as a building where settling of the foundation has occurred. Generally, these devices and methods employ foundation lifting, also known as jacking, equipment such as hydraulicly operated jacks in conjunction with piers, also known as piles or pilings. One or more piers are driven into the ground by means of one or more hydraulic jacks until the pier reaches bedrock or until the pier's frictional resistance equals the compression weight of the structure. Additional lift action then raises the foundation. When the desired foundation level is reached, the pier is permanently attached to the foundation and the hydraulic lift mechanism is removed. These methods typically require excavation of a hole adjacent to or underneath the foundation in order to position and operate the lifting equipment.

U.S. Pat. No. 5,269,630 (Bolin et al., 1993) discloses an apparatus for lifting and stabilizing a structural slab overlying the ground using hydraulic cylinders. A base is attached to the slab, hydraulic cylinders are supported from the base. Piston rods are connected to a head assembly containing a slip clamp which firmly grabs a pier segment. A retraction stroke of the hydraulic cylinders drives the pier into the ground through a hole in the slab. The pier is permanently attached to the base when the slab is lifted to the required level.

U.S. Pat. No. 5,246,311 (West et al., 1993) discloses a foundation repairing system including a pier driver, secondary lilting mechanisms, a pier head and pier sections. The pier head is bolted to the foundation. The pier driving means includes a hydraulic piston-and-cylinder arrangement which is rigidly connected to a pier driving bracket comprising an opposing pair of upright members and a foot member which is fitted underneath the pier head. The piston rod of the hydraulic jack is fitted with an adapter for mating with the distal end of a pier section. A pier section is guided through a sleeve attached to the pier head, fitted onto the adapter and forced downward by the hydraulic jack. Additional pier sections can be fitted end-to-end and driven down until the necessary resistance is encountered from the underlying ground which is sufficient to support the foundation. The pier driver is then removed and a secondary lifting mechanism is affixed to the pier guide to raise the foundation to the desired level. The pier is then permanently attached to the pier guide sleeve.

U.S. Pat. No. 5,234,287 (Rippe, Jr., 1993) discloses a foundation raising and securing apparatus and process wherein a jacking apparatus is coupled to a bracket which is attached to the foundation. The jacking apparatus comprises a hydraulic jack connected to tie-bars which are fastened to a cradle. The cradle is removably coupled to the bracket having a sleeve. The distal end of the ram is provided with a head for compressibly engaging a pier. Pier sections are placed in the jacking apparatus, guided through the sleeve and driven into the ground by hydraulic pressure. Pier sections can be connected end-to-end. Once the pier sections have reached the desired depth, the upper section is permanently attached to the sleeve.

U.S. Pat. No. 5,154,539 (McCown, Sr. et al., 1992) discloses a foundation shoring and stabilizing apparatus wherein pier sections are driven into the ground using a hydraulic jack. A support bracket including a guide member is attached to the foundation. A lifting cradle engages the support bracket. The support cradle is removably attached to the bottom ends of two upright members. A yoke assembly is removably attached to the upper portions of the upright members. A pier driving means, such as a hydraulic cylinder is rigidly attached to the yoke assembly. A piling adapter is mounted to the distal end of the piston rod. A pier section is placed into the guide member and positioned between the upright members wherein the top of the pier is in contact with the downward facing piling adapter of the hydraulic jack. Downward extension of the piston rod forces the pier into the ground and lifts the cradle once the pier sections have reached bedrock. The yoke assembly can be re-positioned at different heights on the upright members in order to move the hydraulic jack to different positions relative to the cradle. Pins are used to restrain the upright members from pivoting outward.

U.S. Pat. No. 4,925,345 (McCown, Jr. et al., 1990) discloses an apparatus for stabilizing and elevating the foundations of buildings using pier sections which are driven down by a pair of power cylinders such as hydraulic jacks. The hydraulic cylinders are attached to an upper head assembly by means of a pair of mounting plates extending laterally from a slip clamp, using clevis connectors and pins. Connecting rods are attached to the upper head assembly and a lower cross arm using clevis connectors. The lower cross arm is mounted to a foundation bracket and a tubular guide sleeve. A pier is fitted through a guide sleeve of the upper head assembly, the slip clamp and the tubular guide sleeve. Upon extending the power cylinders, the slip bowl grips the pier and forces it into a ground.

U.S. Pat. No. 4.911,580 (Gregory et al., 1990) discloses an apparatus and method for raising and supporting a foundation utilizing a pair of hydraulic ram units. Hydraulic cylinders are connected by means of clevis connectors to a pair of mounting plates extending from a lifting arm which is abutted underneath the foundation. The hydraulic rods are connected by means of clevis connectors to horizontal plates of a driving assembly which includes a slip bowl for clamping the pipe when the hydraulic rods are driven in a downward direction. A pair of threaded rods is welded to the lifting arm mounting plates. A pier section support sleeve is connected to a foundation lifting arm. Pier sections are driven into the ground by means of the hydraulic ram units. When the desired foundation level is obtained, the top of the upper pier section is secured to the lifting arms by means of the threaded rods.

It is well known to those skilled in the art that serious difficulties are experienced in practicing the art exemplified in the above referenced patents. Some of these difficulties result from the fact that the foundation lifting and securing process is usually carried out in the confinement of a relatively small excavation. The very limited working space makes it difficult to assemble the equipment, lift and secure the foundation and finally disassemble the equipment. Typically, it is desirable to use equipment which requires the lowest possible vertical clearance. For example, the hydraulic jacks used in pairs in patents '345 and '580 require less vertical clearance than the devices used in patents '287, '311 and '539, because the '345 and '580 hydraulic jacks are positioned parallel to the pier sections while the '287, '311, '539 single hydraulic jacks are supported above and directly in line with pier sections to be driven into the ground.

One particularly troublesome and costly problem involves binding or jamming of pier sections or lift equipment during the lifting or securing. This occurs where the longitudinal axis of a pier section is not in close alignment with the direction in which force is applied to the pier. The mis-alignment manifests itself in binding or jamming of a pier section with such equipment members as guide sleeves and slip bowls. When this occurs it may be necessary to cut the pier or the lift equipment components, resulting in costly delays or the replacement of lift equipment components. Lifting devices employing two parallel hydraulic jacks are particularly prone to mis-alignment because the two jacks may have slightly different performance characteristics, particularly after extensive use of the jacks. These performance differences can result in a difference in ram extension between the two jacks, thereby forcing the pier slip coupling or the pier compression coupling out of alignment with the pier. Single hydraulic jack lifting devices are known to jam against the building structure because of mis-alignment between the pier and the hydraulic jack. For example, U.S. Pat. No. 4,708,528 (Rippe, 1987) teaches that misalignment between the pier and the jacking cylinder causes excessive bending stresses, tilting the jacking equipment against the foundation wall. Known lifting devices and methods have not provided a fully effective solution to the recurring problem of jamming of pier sections or equipment components.

Accordingly, the need exists for devices and methods for lifting and securing structures, such as foundations and slabs, having improved alignment between the pier and the direction in which force is applied to the pier.

SUMMARY OF THE INVENTION

The present invention provides novel devices for lifting and securing structures.

In one embodiment, the current invention provides devices and methods using a hydraulic power means for lifting and securing a foundation element, wherein a pier compression means is pivotally linked to a power cylinder yoke.

In another embodiment, the current invention provides devices and methods using a hydraulic power means for lifting and securing a foundation element, wherein a pier is pivotally linked to a power cylinder yoke.

In still another embodiment, the current invention provides devices and methods using a first power cylinder for lifting and securing a foundation element, wherein a pier compression means is pivotally linked to a power cylinder yoke.

In another embodiment, the present invention provides devices and methods using a first power cylinder for lifting and securing a foundation element, wherein a pier is pivotally linked to a power cylinder yoke.

In yet another embodiment, the present invention provides devices and methods using a first power cylinder and a second power cylinder for lifting and securing a foundation element, wherein a pier compression means is pivotally linked to a power cylinder yoke.

In a further embodiment, the present invention provides devices and methods using a first power cylinder and a second power cylinder for lifting and securing a foundation element, wherein a pier is pivotally linked to a power cylinder yoke.

In another embodiment, the present invention provides devices using a first power cylinder, a second power cylinder and a third power cylinder for lifting and securing a foundation element, wherein a pier is pivotally linked to a power cylinder yoke.

In yet another embodiment, the current invention provides devices using a first power cylinder, a second power cylinder, a third power cylinder and a fourth power cylinder for lifting and securing a foundation element, wherein a pier is pivotally linked to a power cylinder yoke.

DETAILED DESCRIPTION OF THE INVENTION

While describing the invention and its embodiments, certain terminology will be utilized for the sake of clarity. It is intended that such terminology include not only the recited embodiments, but all technical equivalents which perform substantially the same function, in substantially the same manner to achieve substantially the same results.

A foundation element as defined herein includes a foundation, a footing, a foundation support member, a foundation slab and a lower portion of a structure such as a building.

A hydraulic power means as defined herein includes one or more power cylinders to provide lifting power for the devices of the present invention. Where a single power cylinder is used as the hydraulic power means, the first end of the power means comprises the first end of the power cylinder while the second end of the power means comprises the second end of the power cylinder. Where a plurality of power cylinders is used as the hydraulic power means, the power cylinders are substantially identical in dimension and performance and are mounted substantially parallel to each other. The first end of a hydraulic power means utilizing a plurality of power cylinders comprises the first ends of the power cylinders, while the second end of the hydraulic power means comprises the second ends of the power cylinders.

Figure 1:
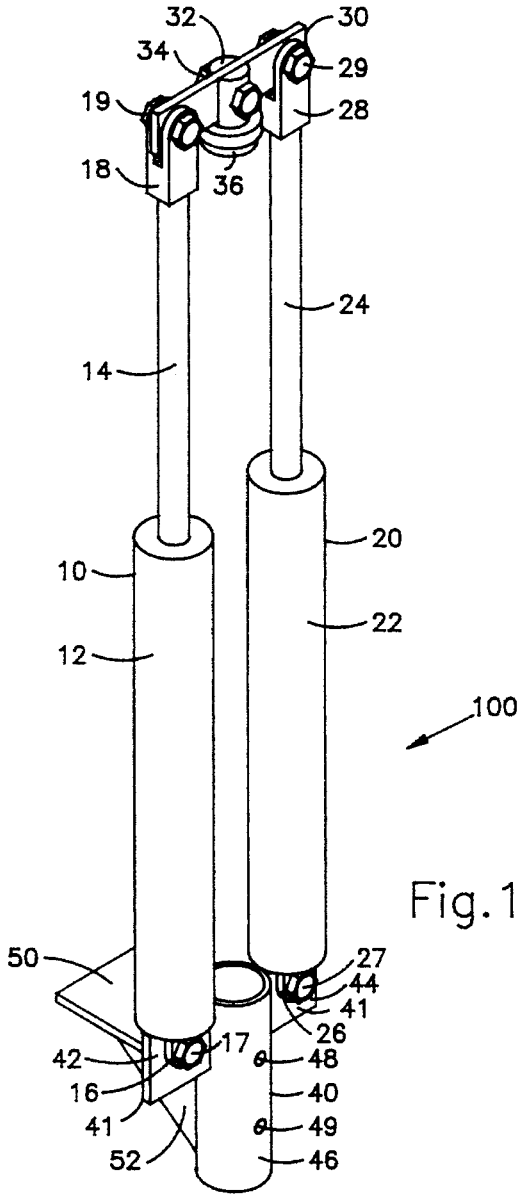
FIG. 1 is a schematic perspective view illustrating a foundation lifting device of the present invention using two power cylinders.

One embodiment of the present invention is illustrated in FIG. 1 showing a structure lifting device 100. The hydraulic power means of device 100 comprises a first power cylinder such as hydraulic jack 10 and a second power cylinder such as hydraulic jack 20 which are utilized to exert force in a direction parallel to the longitudinal axis of these jacks. The dimensions and performance of hydraulic jack 10 are substantially identical to those of hydraulic jack 20. Both jacks are mounted substantially parallel to each other. Jack 10 is a conventional double acting hydraulic jack having a cylinder 12 and a ram (also known as a piston rod) 14. A first end of ram 14 has a reciprocally movable piston (not shown) which is mounted inside cylinder 12. Hydraulic fluid (not shown) is provided under pressure to cylinder 12, through ports (not shown) near either end of cylinder 12. Hydraulic fluid provides force to extend or retract ram 14. A conventional clevis, also referred to as a clevis connector, 16 is attached to a first end of cylinder 12 which is distal to ram 14. The end of ram 14 which is distal to cylinder 12 has a clevis 18 attached thereto. Jack 20, similarly has a cylinder 22 with clevis 26, and a ram 24 with clevis 28.

Clevis connectors 18 and 28 of rams 14 and 28 are pivotally coupled to an articulating bracket such as articulating bar 30. Clevis 18 is pivotally coupled to a first end of articulating bar 30 having a through-hole 31 (not shown). Pivotal fastener 19 is used to pivotally couple clevis 18 to through-hole 31. Clevis 28 is pivotally coupled to a second end of articulating bar 30 having a through-hole 33 (not shown). Pivotal fastener 29 is used to pivotally couple clevis 28 to through-hole 33. A pier compression means such as compression coupling 32 is pivotally coupled to articulating bar 30 through articulating bar through-hole 47 (not shown). Through-hole 47 is equidistant from clevis 18 and clevis 28 and centrally positioned between these clevis connectors. Pivotal fastener 34 extends through compression coupling 32 and through-hole 47.

A cylinder pivotal linking means is provided by a pivotal link between power cylinders 10 and 20, and pier compression means 32 through clevis connectors 18 and 28, pivotal fasteners 19, 29 and 34, and articulating bracket 30. The articulating bar 30 with pivotally mounted compression coupling 32 forms a pier clamping assembly.

A foundation bracket assembly 40 includes a pier guiding means 46, a pier securing means 48 and 49, a foundation attachment means 50, and a power cylinder yoke 41 including a first cylinder mounting plate 42 and a second cylinder mounting plate 44. A typical pier guiding means is exemplified by a guide tube, also known as a sleeve or a support sleeve, 46. Guide tube 46 has an inside diameter which is slightly greater than the outside diameter of the pier to permit the pier to slide through guide tube 46.

The first cylinder mounting plate 42 and the second cylinder mounting plate 44 of yoke 41 are affixed to guide tube 46 on opposite sides of this tube such that both mounting plates and the longitudinal axis (i.e. the cylindrical axis) of guide tube 46 are positioned within the same plane. Clevis 16 is pivotally coupled to cylinder mounting plate 42, using pivotal fastener 17 through cylinder mounting plate through-hole 43 (not shown). Clevis 26 is pivotally coupled to cylinder mounting plate 44, using pivotal fastener 27 through cylinder mounting plate throughhole 45 (not shown), wherein clevis 16 and 26 are each equidistant from the longitudinal axis of guide tube 46. The spacing between clevis 16 and clevis 26 equals the spacing between clevis 18 and 28, as a result hydraulic jack 10 is disposed parallel to hydraulic jack 20. The distance between the center of through-hole 43 and the longitudinal axis of guide tube 46 ranges from about 3 inches to about 12 inches, depending, for example, on the diameter of the hydraulic cylinders and the outer diameter of the pier. A preferred range is from 4 inches to 6 inches.

A foundation attachment means such as support plate 50 is permanently attached to guide tube 46, approximately equidistant between cylinder mounting plates 42 and 44. The plane of support plate 50 is at an approximately 90° angle to the longitudinal axis of guide tube 46. An optional gusset 52, disposed beneath support plate 50, is affixed to guide tube 46 and support plate 50. Pier mounting holes 48 and 49 in guide tube 46 provide a pier securing means as will be more fully described in connection with FIG. 4. Optionally, support plate 50 may include a vertical plate disposed along guide tube 46 to form an L-shaped bracket, or support plate 50 may comprise a support arm.

A yoke coupling means is provided by a first yoke pivotal fastener 17 and a second yoke pivotal fastener 27 to pivotally couple clevis connectors 16 and 26 respectively to cylinder mounting plates 42 and 44. An articulating bracket coupling means is provided by a first articulating bracket pivotal fastener 19 and a second articulating bracket pivotal fastener 29 to pivotally couple clevis connectors 18 and 28 respectively to articulating bar 30. Pivotal fastener 34 pivotally couples compression coupling 32 to articulating bar 30. Importantly, the couplings achieved through pivotal fasteners 17, 19, 27, 29 and 34 provide non-rigid couplings which permit pivotal movement of clevis connectors 16, 18, 26 and 28 and pivotal movement of compression coupling 32, whereby the pier compression means 32 is pivotally linked to the power cylinder yoke 41.

A non-rigid coupling is achieved in a conventional manner such as for example by not tightening the pivotal fasteners 17, 19, 27, 29 and 34 in order to permit movement about these pivotal fasteners. Pivotal fasteners utilized in the present invention include bolt and nut combinations, conventional clevis pins, conventional clevis pin and cotter pin combinations or cylindrical pins. Each of the pivotal fasteners has a fastener shaft of approximately cylindrical shape which forms the pivoting point of the pivotal fastener. The fastener shaft diameter ranges from about ¼ inch to about 2 inches, a preferred range is from ¾ inch to 1¼ inches, depending on the diameter of the aperture through which the fastener shaft is fitted. Preferably, these pivotal fasteners are removable to permit disassembly of lifting device 100. Conventional washers may be used along the inside surface of the ends of the clevis connectors to facilitate pivotal movement. The diameter of the fastener shafts of pivotal fasteners 17, 19, 27 and 29 is 1/32 inch to ⅛ inch smaller than the diameter of the apertures in clevis connectors 16, 18, 26 and 28 respectively, to facilitate pivoting about these fasteners. Preferably, the diameter of the fastener shaft is at least 1/16 inch smaller than the diameter of the clevis apertures through which the shaft is fitted.

Figure 2:
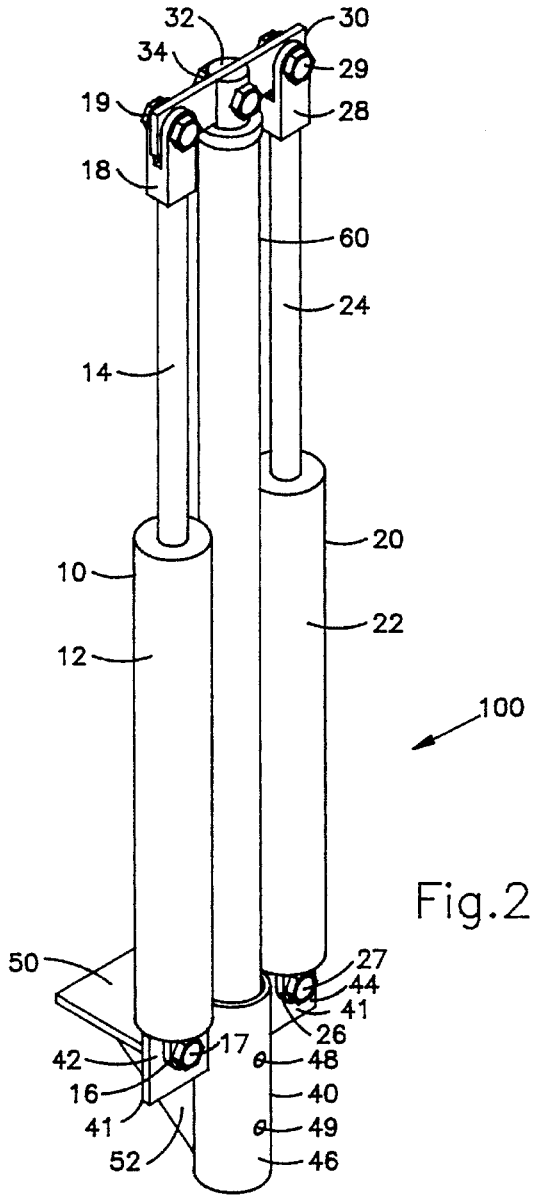
FIG. 2 is a schematic perspective view illustrating the device of FIG. 1 additionally including a pier.

Compression coupling 32 has a first end with through-hole 47 (not shown) and a second end having a downward facing portion 36 which has a reduced cross section. The cross sectional diameter of portion 36 is slightly less than the inner diameter of a pier. Intermediate between its first and second end, compression coupling 32 has a portion having a diameter which exceeds the inner diameter of the pier. As shown in FIG. 2, a pier 60 is introduced into the top opening of guide tube 46 and fitted onto portion 36 of compression coupling 32, whereby pier 60 is pivotally linked to power cylinder yoke 41 through pivotal fasteners 17, 19, 27, 29 and 34, since this provides pivotal movement of the pier compression means 32, the articulating bar 30 and the hydraulic power means.

Figure 3:
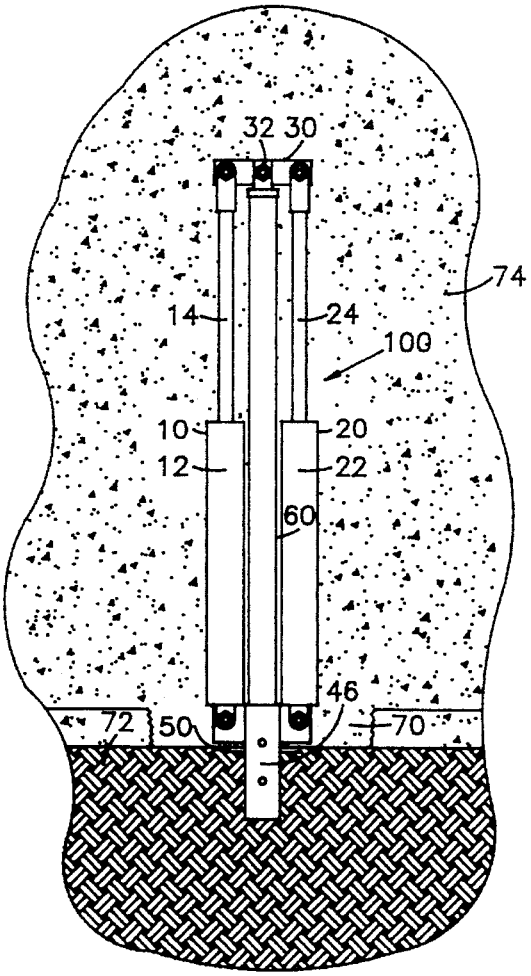
FIG. 3 is a schematic rear elevation view of the device of FIG. 2 attached to a foundation.

FIG. 3 illustrates a typical placement of lifting device 100. Prior to placement of device 100, the building site is prepared by suitable excavation and conventional preparation of the foundation element such as partial removal of a foundation footing if needed. Support plate 50 is abutted underneath a foundation element such as footing 70. Guide tube 46 extends into soil area 72 underneath building structure 74. Hydraulic pressure (not shown) introduced into cylinders 12 and 22 at the ram ends of these cylinders forces rams 14 and 24 respectively to retract into cylinders 12 and 22. The downward force exerted by rams 14 and 24, is transmitted through articulating bar 30 to compression coupling 32, whereby pier 60 is driven into the ground. If necessary, additional pier sections can be fitted end-to-end by means of a pier coupling such as pier coupling 454 of lifting device 400, shown in FIG. 7.

Figure 4:
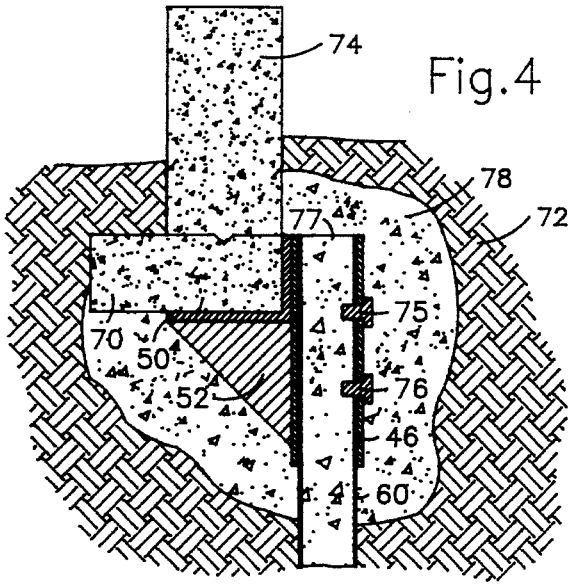
FIG. 4 is a schematic sectional view of a pier connected to a supported and stabilized foundation.

Pier sections are added end-to-end and driven into the ground until the pier has reached bedrock or until the pier's frictional resistance equals the compression weight of the structure. Additional downward pressure exerted on the pier raises the foundation. Pier 60 is permanently attached to guide tube 46 when the desired foundation level is reached, as depicted in FIG. 4. A pier securing means provides permanent attachment of the top part of pier 60 to guide tube 46 for example by drilling holes in the pier through pier mounting holes 48 and 49 in guide tube 46, and inserting screws 75 and 76 through holes 48 and 49 into the newly drilled holes in the pier. It will be understood that one or more pier mounting holes may be used for affixing the pier to the guide tube, alternately, the pier may be bolted, clamped, welded or adhesively bonded to the guide tube using conventional techniques. The hydraulic lift mechanism is then removed. Excess pier material above guide tube 46 is cut away. Concrete slurry 77 may then be introduced into the pier for pier reinforcement. Optionally, a rebar may be secured inside the pier for pier reinforcement with or without hardenable slurry using conventional techniques. Space between the foundation element and the soil can be packed with, for example, a hardenable slurry of cement grout or concrete 78 to provide additional foundation support. The excavation is then back filled.

It will be understood that a plurality of lifting devices 100 may be used for driving piers into the ground at spaced intervals around the foundation to uniformly lift and secure the structure.

Figure 5:
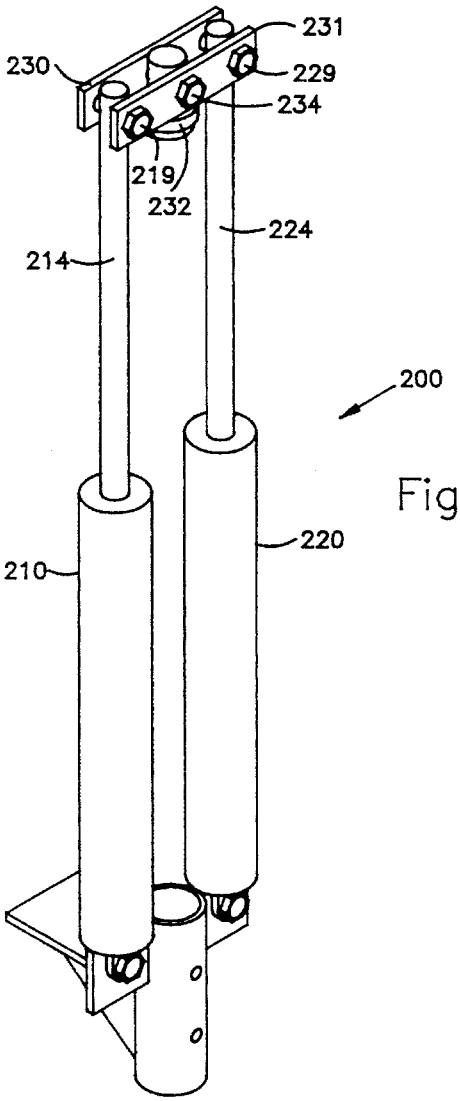
FIG. 5 is a schematic perspective view illustrating an alternate embodiment of the device of FIG. 1.

FIG. 5 illustrates an alternate method of pivotally linking hydraulic rams to an articulating bracket. The hydraulic power means of lifting device 200 uses power cylinders such as hydraulic jacks 210 and 220 which function similarly to the previously described jacks 10 and 20. An articulating bracket such as articulating bars 230 and 231 is pivotally coupled to the distal ends of rams 214 and 224 of hydraulic jacks 210 and 220 respectively. A pivotal fastener 219, inserted through the appropriate aligned through-holes extending through bars 230 and 231 and the distal end of ram 214, provides the pivotal coupling between ram 214 and articulating bars 230 and 231. The distal end of ram 224 is in like manner pivotally coupled by means of pivotal fastener 229 to articulating bars 230 and 231.

Pivotal fastener 234 is used to pivotally couple a pier compression means such as compression coupling 232 to articulating bars 230 and 231 at a position which is equidistant from pivotal fasteners 219 and 229. The holes in articulating bars 230 and 231 and the holes in the distal ends of rams 214 and 224 are preferably 1/16 inch greater than the diameter of the respective fastener shafts to facilitate pivoting about these fastener shafts.

Figure 6:
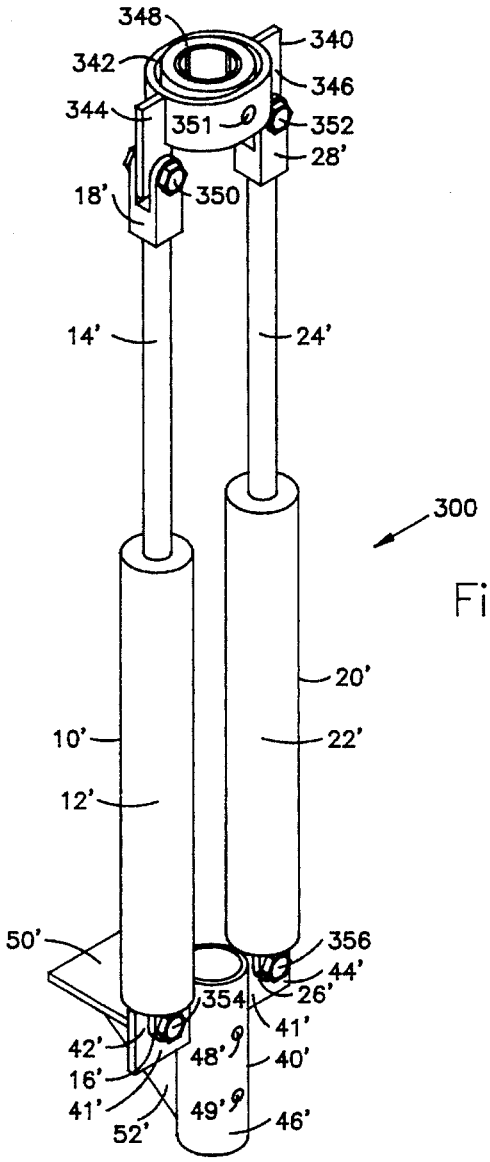
FIG. 6 is a schematic perspective view illustrating an alternate embodiment of a device of the present invention using two power cylinders..

FIG. 6 illustrates an additional embodiment of the present invention showing lifting device 300. As described in connection with FIG. 1, hydraulic jack 10' comprises cylinder 12', ram 14' and clevis connectors 16' and 18'. Likewise, hydraulic jack 20' comprises cylinder 22', ram 24' and clevis connectors 26' and 28'.

An articulating bracket such as slip coupling assembly 340 is pivotally coupled to clevis connectors 18' and 28'. Slip coupling assembly 340 comprises a slip coupling ring 342 and plate-like mounting tabs 344 and 346 which are affixed in opposing positions to slip coupling ring 342. The inner diameter of slip coupling ring 342 ranges from about 1 inch to about 12 inches, depending, for example, on the outer diameter of the pier. A preferred range is from 2 inches to 5 inches. The plane of mounting tabs 344 and 346 is substantially parallel to the cylindrical axis of slip coupling ring 342. A pier compression means such as slip coupling 348 is pivotally attached to slip coupling ring 342 by means of a first pier compression pivotal fastener such as an articulating pin 351 and a second pier compression pivotal fastener such as an articulating pin 353 (not shown). Pivotal fasteners such as articulating pins 351 and 353 are placed in opposing positions in slip coupling ring 342 such that the longitudinal axis of pins 351 and 353 is substantially perpendicular to the plane of mounting tabs 344 and 346.

The cylindrical axis of slip coupling 348 coincides substantially with the cylindrical axis of slip coupling ring 342. Pivoting space is provided between the outside of slip coupling 348 and slip coupling ring 342 such that slip coupling 348 is permitted to pivot in a plane substantially coinciding with the plane of mounting tabs 344 and 346. Conventional slip coupling 348, also known as a "slip bowl", "slip clamp" or "gripping sleeve", has arcuate inserts which are tapered in a vertical direction. The slip coupling will grab or clamp a pier section of appropriate diameter during downward movement of the slip coupling (i.e. when the slip coupling moves towards the guide tube 46'), it will slide over the pier section during upward movement.

Through-holes are provided through mounting tabs 344 and 346 of slip coupling bracket assembly 340 (FIG. 6) to receive pivotal fasteners 350 and 352 such that these through-holes are equidistant from the cylindrical axis of slip coupling ring 342. Clevis connectors 18' and 28' are pivotally coupled to mounting tabs 344 and 346 respectively by pivotal fasteners 350 and 352. Preferably, the diameter of the clevis apertures is at least 1/16 inch greater than the respective fastener shafts. Clevis connectors 18' and 28' are symmetrically disposed about the central axis of slip coupling ring 342. A cylinder pivotal linking means is provided by a pivotal link between power cylinders 10' and 20', and pier compression means 38 through clevis connectors 18' and 28', pivotal fasteners 350, 351,352 and 353, and articulating bracket 340. The slip coupling assembly 340 with pivotally mounted slip coupling 348 forms a pier clamping assembly.

Foundation bracket assembly 40' comprises: cylinder mounting plates 42' and 44', guide tube 46' having pier mounting holes 48' and 49', support plate 50' and optional gusset 52' as previously described in connection with FIG. 1. Clevis 16' of cylinder 12' and clevis 26' of cylinder 22' are pivotally coupled to cylinder mounting tabs 42' and 44' respectively of power cylinder yoke 41' as described in connection with FIG. 1, using pivotal fasteners 354 and 356. The spacing between clevis connectors 16' and 26' equals the spacing between clevis connectors 18' and 28', as a result hydraulic jack 10' is disposed parallel to hydraulic 20'.

Pivotal fasteners 350, 352, 354 and 356 (FIG. 6) are similar to the pivotal fasteners described in connection with FIG. 1. The diameter of the fastener shafts of pivotal fasteners 350, 352, 354 and 356 is 1/32 inch to 1/8 inch smaller than the diameter of the apertures in clevis connectors 16', 18', 26' and 28' respectively, to facilitate pivoting about these fasteners. Preferably, the diameter of the fastener shaft is at least 1/16 inch smaller than the diameter of the clevis apertures through which the shaft is fitted. A yoke coupling means is provided by the first yoke pivotal fastener 354 and the second yoke pivotal fastener 356. An articulating bracket coupling means is provided by the first articulating bracket pivotal fastener 350 and the second articulating bracket pivotal fastener 352. Pivotal coupling is provided in lifting device 300 at non-rigid coupling pivotal fasteners 350, 352,354 and 356, and at articulating pins 351 and 353, whereby the pier compression means 348 is pivotally linked to the power cylinder yoke 41'

Lifting device 300 is placed adjacent to the foundation (not shown), similar to the manner depicted in FIG. 3, with support plate 50 abutting the underside of the foundation element. A pier section (not shown) is guided through slip coupling 348 of lifting device 300, and through guide sleeve 46' The pier is pivotally linked to power cylinder yoke 41' through pivotal fasteners 350, 351,352, 353, 354 and 356, since this provides pivotal movement of the pier compression means 348, the articulating bracket 340 and the hydraulic power means. Hydraulic pressure is applied to hydraulic jacks 10' and 20' forcing rams 14' and 24' downward. Downward movement of the slip coupling assembly 340 causes slip coupling 348 to grab the pier section, driving it into the ground.

Figure 7:
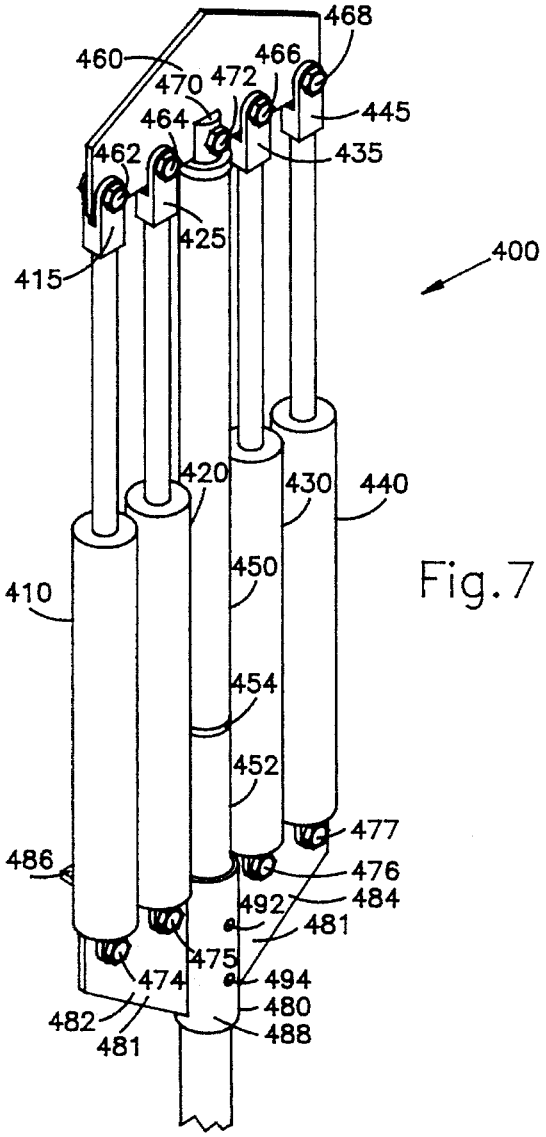
FIG. 7 is a schematic perspective view illustrating a device of the present invention using four power cylinders.

Lifting device 400 shown in FIG. 7 illustrates an additional alternate embodiment of the present invention. This lifting device is similar to lifting device 100 described previously except that the hydraulic power means of lifting device 400 uses four power cylinders, such as hydraulic jacks, compared with two hydraulic jacks utilized in lifting device 100. The four hydraulic jacks 410, 420, 430 and 440 have substantially similar dimensions and performance. The longitudinal axis of each of these jacks is substantially parallel to the longitudinal axis of guide tube 488 and substantially parallel to the longitudinal axis of a pier section 450 which is placed in the lifting device in a manner similar to FIG. 2.

Returning to FIG. 7, jacks 420 and 430 are substantially equidistant from pier section 450. Jacks 410 and 440 likewise are substantially equidistant from pier section 450. The clevis connectors 415, 425, 435 and 445 of each ram of jacks 410, 420, 430 and 440 respectively are pivotally coupled to an articulating bracket such as articulating bar 460 using pivotal fasteners 462, 464, 466 and 468 respectively, wherein these pivotal fasteners comprise an articulating bracket coupling means. A pier compression means such as compression coupling 470 is pivotally coupled to articulating bar 460 using pivotal fastener 472. Pivotal fasteners 462, 464, 466, 468 and 472 are positioned in substantially the same plane. A cylinder pivotal linking means is provided by a pivotal link between power cylinders 410, 420, 430 and 440, and pier compression means 470 through clevis connectors 415, 425, 435 and 445, pivotal fasteners 462, 464, 466, 468 and 472, and articulating bracket 460. The articulating bar 460 with pivotally mounted compression coupling 470 forms a pier clamping assembly.

Foundation bracket assembly 480 of lifting device 400 includes a power cylinder yoke 481 having a first cylinder mounting plate 482 and a second cylinder mounting plate 484, support plate 486 and guide tube 488 having pier mounting holes 492 and 494. The clevis connectors at the bottom of the cylinders of jacks 410 and 420 are pivotally coupled to cylinder mounting plate 482 using pivotal fasteners 474 and 475 respectively. Likewise, the clevis connectors of the cylinders of jacks 430 and 440 are pivotally coupled to cylinder mounting plate 484 using pivotal fasteners 476 and 477 respectively. Pivotal fasteners 474, 475, 476 and 477 are positioned in substantially the same plane, wherein these pivotal fasteners comprise a yoke coupling means.

The diameter of the fastener shafts of pivotal fasteners 462, 464, 466, 468, 474, 475, 476 and 477 is 1/32 inch to 1/8 inch smaller than the diameter of the apertures of the respective clevis connectors to facilitate pivoting about these fasteners. Preferably, the diameter of the fastener shaft is at least 1/16 inch smaller than the diameter of the clevis apertures through which the shaft is fitted. Pivotal coupling is provided in lifting device 400 at pivotal fasteners 462, 464, 466, 468, 472, 474, 475, 476 and 477 which are non-rigid couplings, whereby the pier compression means 470 is pivotally linked to the power cylinder yoke 481 thus providing a pivotal link between pier section 450 and power cylinder yoke 481, since this provides pivotal movement of tile pier compression means 470, the articulating bar 460 and the hydraulic power means.

FIG. 7 shows pier section 450 fitted end-to-end to pier section 452 in a conventional manner by means of conventional pier coupling 454, such as an elongated rod with a diameter suitable for insertion into the hollow portions of adjacent pier sections.

Figure 8:
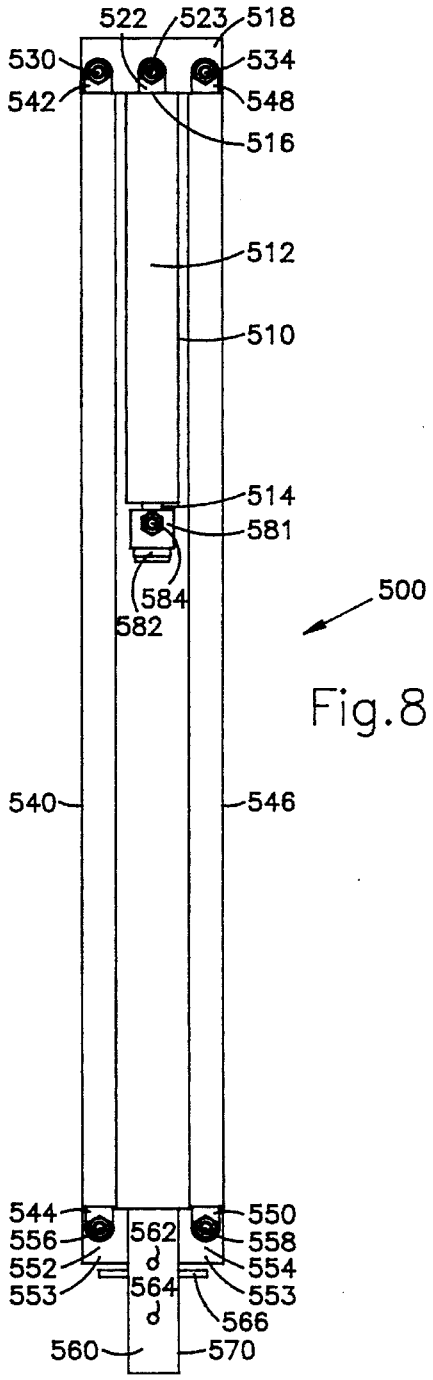
FIG. 8 is a schematic rear elevation view illustrating a lifting device of the present invention using one power cylinder.

FIG. 8 depicts yet another embodiment of the present invention showing lifting device 500 which utilizes a hydraulic power means comprising a single power cylinder 510 having a hydraulic cylinder 512 and a ram 514. The closed end 516 of hydraulic cylinder 512 is rigidly mounted to cylinder bracket 518 using conventional mounting means such as a cylinder mounted clevis 522 and bolt 523. Cylinder bracket 518 is pivotally attached to upright members 540 and 546. Pivoting upright members 540 and 546 are approximately equal in length and are disposed substantially parallel to the longitudinal axis of power cylinder 510. Upright members 540 and 546 are positioned equidistant form the longitudinal axis of power cylinder 510. Clevis 542 is mounted to a first end of pivoting upright member 540, while clevis 544 is mounted to the second end of pivoting upright member 540. Clevis connectors 548 and 550 are similarly mounted to pivoting upright member 546. Pivotal fastener 530 is inserted through clevis 542 and through-hole 528 (not shown) through cylinder bracket 518 to provide pivotal coupling. Likewise, pivotal fastener 534 is inserted through clevis 548 and through-hole 532 (not shown) through cylinder bracket 518, whereby cylinder bracket 518 is pivotally coupled to pivoting upright members 540 and 546.

Pivoting upright members 540 and 546 are pivotally coupled to a foundation bracket assembly 570 which is similar to foundation bracket assembly 40 described in connection with FIG. 1. Returning to FIG. 8, clevis 544 is pivotally coupled to through-hole 557 (not shown) of a first cylinder mounting plate 552 using pivotal fastener 556. Similarly, pivotal fastener 558 is used to pivotally couple clevis 550 to through-hole 559 (not shown) of a second cylinder mounting plate 554. The spacing between pivotal fasteners 530 and 534 is approximately equal to the spacing between pivotal fasteners 556 and 558, thus resulting in substantially parallel positioning of pivoting upright members 540 and 546. The distance between through-hole 557 and the longitudinal axis of the guide tube 560 ranges from about 3 inches to about 12 inches, depending, for example, on the diameter of the pier and the width of upright members 540 and 546. A preferred range is from 4 inches to 6 inches.

As shown in FIG. 8, cylinder mounting plates 552 and 554 of power cylinder yoke 553 are mounted to guide tube 560 which has pier mounting holes 562 and 564. Support plate 566 is affixed to guide tube 560. A clevis 581 is attached to ram 514. A pier compression means such as a pier compression coupling 582, similar to pier compression coupling 232 described above is pivotally coupled to clevis 581 by means of a pivotal fastener 584. A cylinder pivotal linking means is provided by a pivotal link between power cylinder 510 and pier compression means 582 through clevis 581 and pivotal fastener 584. The diameter of the fastener shafts of pivotal fasteners 530, 534, 556 and 558 is at least 1/32 inch to 1/8 inch smaller than the diameter of the apertures in clevis connectors 542, 548, 544 and 550 respectively, in order to facilitate pivotal coupling at these points in lifting device 500. Preferably, the diameter of the fastener shaft is at least 1/16 inch smaller than the diameter of the clevis apertures through which the shaft is fitted.

A yoke coupling means is provided by pivotal fasteners 556 and 558. A cylinder bracket coupling means is provided by pivotal fasteners 530 and 534. Pivotal coupling is provided in lifting device 500 at pivotal fasteners 530, 534, 556, 558 and 584 which are non-rigid couplings, whereby the pier compression means 582 is pivotally linked to the power cylinder yoke 553, since this provides pivotal movement between the pier compression means 582, the hydraulic power means, the upright members 540 and 546, and the power cylinder yoke.

A pier (not shown) is introduced into guide tube 560 of lifting device 500 (FIG. 8) and fitted to pier compression coupling 582, as described in connection with FIG. 2. The pier is pivotally linked to power cylinder yoke 553 through pivotal fasteners 530, 534, 556, 558 and 584, pier compression coupling 582, cylinder bracket 518 and upright members 540 and 546. When hydraulic jack 510 of lifting device 500 is energized ram 514 is extended, driving the pier into the ground.

Figure 9:
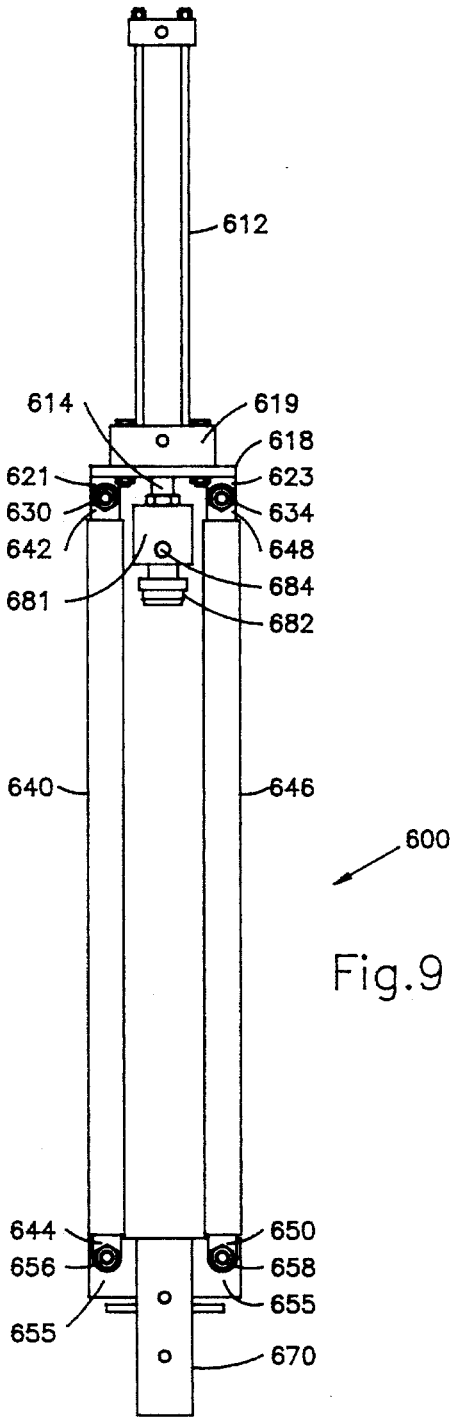
FIG. 9 is a schematic rear elevation view illustrating an alternate lifting device of the current invention using one power cylinder.

FIG. 9 depicts an alternate embodiment of a single power cylinder lifting device of the present invention wherein the hydraulic power means comprises a single power cylinder. Power cylinder 612 of lifting device 600 is mounted to cylinder bracket 618 using a conventional cylinder mount 619. Bracket 618 has mounting tabs 621 and 623 having through-holes 628 (not shown) and 632 (not shown) respectively. The clevis connectors 642 and 648 of upright members 640 and 646 are pivotally coupled to through-holes 628 and 632 of bracket 618 using pivotal fasteners 630 and 634. The clevis connectors 644 and 650 of upright members 640 and 646 are pivotally fastened to power cylinder yoke 655 of foundation bracket assembly 670 using pivotal fasteners 656 and 658 respectively, in a manner similar to the description in connection with FIG. 8. A pier compression means such as a pier compression coupling 682 is pivotally coupled to clevis 681 of ram 614 by means of pivotal fastener 684.

The diameter of the fastener shafts of pivotal fasteners 630, 634, 656 and 658 is 1/32 inch to 1/8 inch smaller than the diameter of the apertures in clevis connectors 642, 648, 644 and 650 respectively, to facilitate pivoting about these fasteners. Preferably, the diameter of the fastener shaft is at least 1/16 inch smaller than the diameter of the clevis apertures through which the shaft is fitted. A yoke coupling means is provided by pivotal fasteners 656 and 658. A cylinder bracket coupling means is provided by pivotal fasteners 630 and 634. Pivotal coupling is provided in lifting device 600 at pivotal fasteners 630, 634, 656, 658 and 684 which are nonrigid couplings, whereby the pier compression means 682 is pivotally linked to the power cylinder yoke 655, since these pivotal fasteners provide pivotal movement of the pier compression coupling 682, the cylinder bracket 618 and upright members 640 and 646.

Figure 10:
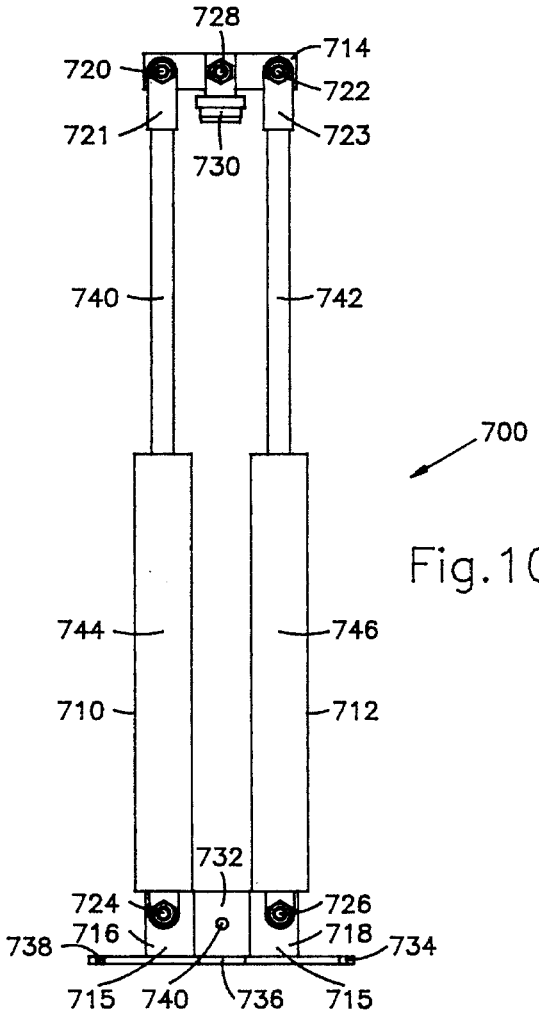
FIG. 10 is a schematic rear elevation view illustrating a slab lifting device of the present invention using two power cylinders.

A slab lifting device 700 illustrates an alternate embodiment of the present invention as shown in FIG. 10 utilizing a hydraulic power means comprising two power cylinders. Power cylinders 710 and 712 are pivotally coupled to an articulating bracket such as articulating bar 714, and to a first cylinder mounting plate 716 and a second cylinder mounting plate 718 of power cylinder yoke 715 in a manner similar to lifting device 100 described in connection with FIG. 1. Pivotal fasteners 720, 722, 724 and 726 provide pivotal coupling of power cylinders 710 and 712 which are mounted in substantially parallel positions. A pier compression means such as a pier compression coupling 730 is pivotally coupled to articulating bar 714 by means of pivotal fastener 728. The diameter of the fastener shafts of pivotal fasteners 720, 722, 724 and 726 is 1/32 inch to 1/8 inch smaller than the diameter of the apertures of the respective clevis connectors, in order to facilitate pivotal coupling at these points in lifting device 700. Preferably, the diameter of the fastener shaft is at least 1/16 inch smaller than the diameter of the apertures through which the shaft is fitted.

A yoke coupling means is provided by pivotal fasteners 720 and 722. An articulating bracket coupling means is provided by pivotal fasteners 724 and 726. A cylinder pivotal linking means is provided by a pivotal link between power cylinders 710 and 712, and pier compression means 730 through clevis connectors 721 and 723, pivotal fasteners 720, 722 and 728, and articulating bracket 714. The articulating bar 714 with pivotally mounted compression coupling 730 forms a pier clamping assembly.

Mounting plates 716 and 718 of power cylinder yoke 715 are mounted to a guide tube 732 (FIG. 10). A support plate 734 which is mounted to guide tube 732, extends beyond the circumference of the guide tube and includes an aperture 736 which is substantially collinear with the interior space of the guide tube. One or more mounting holes 738 are provided in support plate 734 to mount support plate 734 to an underlying slab. A pier securing means such as one or more pier securing holes 740 may be provided in guide tube 732 to secure a pier to guide tube 732 when the slab is lifted to the desired level. The foundation bracket assembly of device 700 includes the power cylinder yoke 715, the guide tube 732, the pier securing means 740 and the support plate 734. Pivotal coupling is provided in slab lifting device 700 at pivotal fasteners 720, 722, 724, 726 and 728 which are non-rigid couplings.

The building site is prepared using conventional techniques by preparing a hole in the slab for insertion of the pier and by preparing one of more mounting holes in the slab for mounting support plate 734 to the slab. A pier (not shown) is inserted into guide tube 732 and fitted onto compression coupling 730, as described in connection with FIG. 2. The pier is pivotally linked to the power cylinder yoke 715 of the foundation bracket assembly through pivotal fasteners 720, 722, 724, 726, and 728, since these fasteners provide pivotal movement of the pier compression means 730, the articulating bracket 714 and the hydraulic power means. Upon energizing power cylinders 710 and 712, rams 740 and 742 are retracted into cylinders 744 and 746 respectively, driving the pier into the ground.

The term pier compression means as defined in the present invention is limited to the device element which contacts the pier directly in a compressive manner by compression on one end of the pier or by gripping a portion of the outer surface of the pier, when the hydraulic power means is activated. This device element does not include any component, such as a bracket, which may be interposed between this element and the hydraulic power means. Examples of suitable pier compression means include pier compression couplings and slip couplings.

An important feature of the embodiments of the present invention is the pivotal coupling at both ends of the power cylinders as well as at the pier compression means. The pivotal coupling at these points combined with the relative loose fit of the pier inside the guide tube enables devices according to this invention to pivot at these points during the process of driving the pier into the ground. Pivoting of the devices of the present invention unexpectedly results in self-alignment of the device and the pier as it is driven into the ground, thereby substantially preventing the jamming of pier sections or device components.

The lifting devices of the present invention provide several pivoting modes during foundation lifting as follows. A first pivoting mode allows pivotal movement in a plane approximately parallel to the side of the structure, in other words if an operator faces the structure this pivoting movement is seen by the operator as a left or right pivoting about the power cylinder yoke of the foundation bracket assembly. A second pivoting mode allows pivotal movement such that the top of the device can move away from or closer to the side of the structure by pivoting about the power cylinder yoke of the foundation bracket assembly. This second pivoting mode is particularly facilitated by a loose fit between the pivotal fasteners and the respective apertures through which they are fitted. A third pivoting mode is a composite of the first and second pivoting modes. A fourth mode of pivoting occurs in devices having two power cylinders which do not have identical performance, for example when one of the two power cylinder rams does not extend as fully or as rapidly as the other power cylinder ram. When this occurs the lifting devices of the current invention allow both the articulating bar and the pier compression means to pivot, thus compensating for the unequal performance of the power cylinders. The pivoting modes of the present invention result in a pivotal linkage between the pier and the power cylinder yoke of the foundation bracket assembly.

Providing a loose fit between the fastener shafts and the apertures through which the pivotal fasteners are fitted results in unanticipated enhancement of the self-alignment capability of the devices of the current invention. Unexpectedly, the loose fit of these pivotal fasteners does not impede the devices' capabilities for lifting heavy structures.

Clevis connections in lifting devices are well known. Typically, these connections are between some individual components of a device but not in such manner as to result in a pivotal linkage between the pier compression means and the hydraulic power means or a pivotal linkage between the pier and the foundation bracket assembly. For example, Bolin '630 teaches clevis connections between the piston rods and a head assembly, but there is no pivoting connection between the head assembly and the pier. McCown, Sr. et al., '539 teach coupling between a yoke assembly and vertical members wherein the yoke assembly and a lifting cradle are affixed to the horizontal members by means of pins inserted in apertures in the yoke assembly, saddle and vertical members but there is no pivoting connection between the yoke assembly and the pier. McCown, Jr. et al. '345 teach clevis connections between hydraulic jacks and an upper head assembly containing a slip clamp, however there is no pivoting connection between the hydraulic jacks and the pier because the slip clamp is rigidly attached to the upper head assembly. Gregory et al. '580 teach clevis connections between hydraulic jacks and a driving assembly containing a gripping sleeve for clamping a pier, there is however no pivoting connection between the driving assembly and the pier. Unlike the present invention, the above referenced Bolin, McCown Sr., McCown Jr. and Gregory et al. patents do not provide for pivoting between the hydraulic power means and the pier compression means or pivoting between the pier and the foundation bracket assembly because these patents utilize pier compression means which are rigidly secured to a member which is coupled to the power cylinders.

Additional alternate embodiments (not shown) are contemplated within the scope of the present invention using a hydraulic power means comprising three or more substantially identical jacks, wherein each jack is pivotally positioned equidistant from the pier section, thus forming a cluster configuration of jacks around the pier section.

The current invention is described using foundation bracket assemblies wherein the bracket is attached to a foundation element by means of a support plate which is disposed underneath the foundation element. However, alternate conventional foundation attachment means are equally operable. Examples of suitable foundation attachment means include a plate attached to a guide tube wherein the plate is adapted to be secured to the side wall of the foundation (see, for example, U.S. Pat. No. 5,234,287), a support arm (see, for example, U.S. Pat. No. 4,911,580) and a rod directed radially from a guide tube wherein the rod is inserted into a hole in the side wall of the foundation (see, for example, U.S. Pat. No. 4,708,528 issued to Rippe in 1987). Suitable attachment means for attaching a slab lifting device to a foundation slab are well known in the art, see, for example, U.S. Pat. No. 5,234,287.

Typically, materials of construction employed in the lifting devices of the current invention include various metals, but other materials, such as, for example, reinforced plastics are also contemplated.

The current invention is illustrated using pier sections having a circular cross section. However, other cross sectional profiles are similarly operable, such as, for example, square, rectangular and triangular. When piers having a non-circular configuration are used, various components of embodiments of the present invention may be appropriately configured in a known manner to drive and securely engage such other configured piers. These components include compression couplings, pier couplings, slip couplings, slip coupling rings and guide tubes. It will be understood that a pier as defined herein can comprise one continuous pier or a number of pier sections added end-to-end, fitted together by means of conventional pier couplings.

The invention has been described in terms of the preferred embodiments. One skilled in the art will recognize that it would be possible to construct the elements of the present invention from a variety of means and to modify the placement of components in a variety of ways. While the preferred embodiments have been described in detail and shown in the accompanying drawings, it will be evident that various further modifications are possible without departing from the scope of the invention as set forth in the following claims. For example, while the invention is illustrated by examples wherein the hydraulic cylinder is pivotally coupled to the foundation bracket assembly, the invention is equally operable where the ram is pivotally coupled to the foundation bracket assembly and the cylinder is pivotally coupled to the articulating bracket.

I claim:

1. A lifting device suitable for lifting and securing a foundation element comprising:

a) a first power cylinder having (1) a first end and (2) a second end;

b) a second power cylinder having (1) a first end and (2) a second end, wherein the second power cylinder is substantially identical to the first power cylinder;

c) a first clevis connector attached to the first end of the first power cylinder, wherein the first clevis connector has (1) a first area defining an aperture having a predetermined diameter and (2) a second area defining an aperture having a predetermined diameter approximately equal to the diameter of the first aperture;

d) a second clevis connector attached to the second end of the first power cylinder, wherein the second clevis connector has (1) a third area defining an aperture having a predetermined diameter and (2) a fourth area defining an aperture having a predetermined diameter approximately equal to the diameter of the third aperture;

e) a third clevis connector attached to the first end of the second power cylinder wherein the third clevis connector has (1) a fifth area defining an aperture having a predetermined diameter and (2) a sixth area defining an aperture having a predetermined diameter approximately equal to the predetermined diameter of the fifth aperture;

f) fourth clevis connector attached to the second end of the second power cylinder, wherein the fourth clevis connector has (1) a seventh area defining an aperture having a predetermined diameter and (2) an eighth area defining an aperture having a predetermined diameter approximately equal to the diameter of the seventh aperture;

g) a pier guiding means adapted for slidably receiving a pier, wherein the pier guiding means has (1) a center and (2) a longitudinal axis through the center;

h) a pier securing means adapted for selectively securing the pier to the pier guiding means when the foundation element is lifted to a predetermined level;

i) a foundation attachment means for attaching the lifting device to the foundation element, wherein the foundation attachment means is mounted to the pier guiding means;

j) a power cylinder yoke mounted to the pier guiding means;

k) a power cylinder yoke coupling means comprising: (1) a first yoke pivotal fastener for pivotally coupling the first clevis connector to the power cylinder yoke, wherein the first yoke pivotal fastener has a fastener shaft having a diameter which is 1/32 inch to 1/8 inch smaller than the diameter of the first aperture and (2) a second yoke pivotal fastener for pivotally coupling the third clevis connector to the power cylinder yoke, wherein the second pivotal fastener has a fastener shaft having a diameter which is 1/32 inch to 1/8 inch smaller than the diameter of the fifth aperture;

l) an articulating bracket;

m) a pier compression means adapted for compressibly engaging the pier;

n) a first pier compression pivotal fastener for pivotally coupling the pier compression means to the articulating bracket; and o) an articulating bracket coupling means comprising: (1) a first articulating bracket pivotal fastener for pivotally coupling the second clevis connector to the articulating bracket, wherein the first articulating bracket pivotal fastener has a fastener shaft having a diameter which is 1/32 inch to 1/8 inch smaller than the diameter of the third aperture and (2) a second articulating bracket pivotal fastener for pivotally coupling the fourth clevis connector to the articulating bracket, wherein the second articulating bracket pivotal fastener has a fastener shaft having a diameter which is 1/32 inch to 1/8 inch smaller than the diameter of the seventh aperture, whereby the pier compression means is pivotally linked to the power cylinder yoke.

2. The lifting device according to claim 1 additionally comprising the pier having (1) a predetermined outer profile, (2) a predetermined outer diameter and (3) a predetermined inner diameter, wherein the pier is slidably received by the pier guiding means and wherein the pier is compressibly engaged by the pier compression means, whereby the pier is pivotally linked to the power cylinder yoke.

3. The lifting device according to claim 2 wherein the pier comprises two or more pier sections secured together in an end-to-end relationship.

4. The lifting device according to claim 2 wherein the first and second yoke pivotal fastener, the first and second articulating bracket pivotal fastener, and the first pier compression pivotal fastener are selected from the group of fasteners consisting of bolt and nut combinations, clevis pin and cotter pin combinations, clevis pins and cylindrical pins.

5. The lifting device according to claim 2 having a first power cylinder comprising:

a) a hydraulic cylinder having (1) a first end, (2) a second end and (3) a predetermined outer diameter;

b) a piston reciprocally moveable within the hydraulic cylinder;

c) a ram attached to the piston having (1) a ram first end and (2) a ram second end, wherein the ram first end is distal from the piston and wherein the ram extends from the second end of the hydraulic cylinder;

d) a power cylinder first end coinciding with the hydraulic cylinder first end; and e) a power cylinder second end coinciding with the ram first end.

6. The lifting device according to claim 5 wherein the power cylinder comprises a double acting hydraulic jack.

7. The lifting device according to claim 2 wherein the pier guiding means comprises a guide tube having (1) a tube wall, (2) an outside surface, (3) an inner profile substantially similar to the outer profile of the pier and (4) a predetermined inner diameter which exceeds the outer diameter of the pier by a predetermined measure E.

8. The lifting device according to claim 7 wherein the predetermined measure E is at least 1/16 inch.

9. The lifting device according to claim 2 wherein the pier securing means comprises:

a) at least one section defining a through-hole through the wall of the guide tube; and b) at least one pier fastener extending through the through hole in the wall of the guide tube, wherein the pier fastener is selected from the group consisting of bolts, screws, rivets, pins and rods.

10. The lifting device according to claim 2 wherein the pier securing means comprises a fastening means selected from the group consisting of clamping, welding, and adhesively bonding.

11. The lifting device according to claim 2 wherein the foundation attachment means is selected from the group consisting of a support plate adapted for disposing underneath the foundation element, a support arm adapted for disposing underneath the foundation element, a plate adapted for securing to the foundation element and a rod directed radially from the guide tube for insertion into an area defining a hole in the foundation element.

12. The lifting device according to claim 2 wherein the power cylinder yoke comprises:

a) a first cylinder mounting plate secured to the pier guiding means such that the plane of the first cylinder mounting plate substantially coincides with the longitudinal axis of the pier guiding means, in which the first cylinder mounting plate has an area defining a through-hole having a predetermined diameter for receiving the fastener shaft of the first yoke pivotal fastener wherein the through-hole is spaced a predetermined distance G from the longitudinal axis of the pier guiding means in which G ranges from about 3 inches to about 12 inches;

b) a second cylinder mounting plate secured to the pier guiding means such that the second cylinder mounting plate is positioned opposite the first cylinder mounting plate and the plane of the second cylinder mounting plate substantially coincides with the longitudinal axis of the pier guiding means, in which the second cylinder mounting plate has an area defining a through-hole having a predetermined diameter for receiving the fastener shaft of the second yoke pivotal fastener wherein the through-hole is spaced a predetermined distance G from the longitudinal axis of the pier guiding means.

13. The lifting device according to claim 12 wherein the articulating bracket comprises an articulating bar having (1) a first end wherein the first end has an area defining a through-hole having a predetermined diameter for receiving the fastener shaft of the first articulating bracket pivotal fastener, (2) a second end wherein the second end has an area defining a through-hole having a predetermined diameter for receiving the fastener shaft of the second articulating bracket pivotal fastener and (3) a midpoint centrally positioned between the articulating bar first end through-hole and the articulating bar second end through-hole, in which the midpoint is positioned at a distance G from the articulating bar first through-hole and from the articulating bar second through-hole, wherein the articulating bar midpoint has an area defining a through-hole for receiving the first pier compression pivotal fastener.

14. The lifting device according to claim 13 wherein the pier compression means comprises a plug-shaped member having (1) a first end having an area defining a through-hole having a longitudinal axis, for receiving the first pier compression pivotal fastener, (2) a second end having a predetermined outer diameter which is smaller than the predetermined inner diameter of the pier and (3) an enlarged portion intermediate it first end and its second end having a predetermined diameter which is greater than the inner diameter of the pier.

15. The lifting device according to claim 14 wherein the first end of the pier compression means has a portion defining a slot for receiving the articulating bar, wherein the plane of the slot is substantially perpendicular to the longitudinal axis of the compression means through-hole.

16. The lifting device according to claim 12 additionally comprising a second pier compression pivotal fastener for pivotally coupling the pier compression means to the articulating bracket.

17. The lifting device according to claim 16 wherein the articulating bracket comprises:

a) a slip coupling ring having (1) a cylindrical axis, (2) an inner diameter ranging from about 1 inch to about 12 inches, (3) a first area defining a through-hole for receiving the first pier compression pivotal fastener and (4) a second area defining a through-hole for receiving the second pier compression pivotal fastener, wherein the second through-hole is positioned opposite the first slip coupling ring through-hole;

b) a plate-like first mounting tab attached to the slip coupling ring such that the first mounting tab is equidistant between the first and second slip coupling through-holes and the plane of the first mounting tab substantially coincides with the cylindrical axis of the slip coupling ring, wherein the first mounting tab has an area defining a through-hole having a predetermined diameter for receiving the fastener shaft of the first articulating bracket pivotal fastener, in which the first mounting tab through-hole is spaced a predetermined distance G from the cylindrical axis of the slip coupling ring; and c) a plate-like second mounting tab attached to the slip coupling ring such that the second mounting tab is positioned opposite the first mounting tab wherein the second mounting tab is equidistant between the first and second slip coupling through-holes and the plane of the second mounting tab substantially coincides with the cylindrical axis of the slip coupling ring, wherein the second mounting tab has an area defining a through-hole having a predetermined diameter for receiving the fastener shaft of the second articulating bracket pivotal fastener, in which the second mounting tab through-hole is spaced a predetermined distance G from the cylindrical axis of the slip coupling ring.

18. The lifting device according to claim 17 wherein the pier compression means comprises a slip coupling for receiving the pier, having (1) a first area defining a through-hole for receiving the first pier compression pivotal fastener and (2) a second area defining a through-hole for receiving the second pier compression pivotal fastener, wherein the second through-hole is positioned opposite the first slip coupling through-hole.

19. A lifting device suitable for lifting and securing a foundation element comprising:

a) a power cylinder having (1) a first end and (2) a second end;

b) a pier guiding means adapted for slidably receiving a pier, wherein the pier guiding means has (1) a center and (2) a longitudinal axis through the center;

c) a pier securing means adapted for selectively securing the pier to the pier guiding means when the foundation element is lifted to a predetermined level;

d) a foundation attachment means for attaching the lifting device to the foundation element, wherein the foundation attachment means is mounted to the pier guiding means;

e) power cylinder yoke mounted to the pier guiding means;

f) a first upright member having (1) a first end and (2) a second end;

g) a second upright member having (1) a first end and (2) a second end, wherein the second upright member is substantially identical to the first upright member:

h) a first clevis connector attached to the first end of the first upright member, wherein the first clevis connector has (1) a first area defining an aperture having a predetermined diameter and (2) a second area defining a aperture having a predetermined diameter approximately equal the diameter of the first aperture;

i) a second clevis connector attached to the second end of the first upright member, wherein the second clevis connector has (1) a third area defining an aperture having a predetermined diameter and (2) a fourth area defining an aperture having a diameter approximately equal to the diameter of the third aperture;

j) a third clevis connector attached to the first end of the second upright member, wherein the third clevis connector has (1) a fifth area defining an aperture having a predetermined diameter and (2) a sixth area defining an aperture having a diameter approximately equal to the diameter of the fifth aperture;

k) a fourth clevis connector attached to the second end of the second upright member, wherein the fourth clevis connector has (1) a seventh area defining a aperture having a predetermined diameter and (2) an eighth area defining an aperture having a diameter approximately equal to the diameter of the seventh aperture;

l) a yoke coupling means comprising: (1) a yoke first pivotal fastener for pivotally coupling the first clevis connector to the power cylinder yoke, wherein the first pivotal fastener has a fastener shaft having a diameter which is 1/32 inch to 1/8 inch smaller than the diameter of the first aperture and (2) a second yoke pivotal fastener for pivotally coupling the third clevis connector to the power cylinder yoke, wherein the second yoke pivotal fastener has a fastener shaft having a diameter which is 1/32 inch to 1/8 inch smaller than the diameter of the fifth aperture:

m) a cylinder bracket mounted to the first end of the power cylinder;

n) a fifth clevis connector mounted to the second end of the power cylinder;

o) pier compression means adapted for compressibly engaging the pier;

p) pier compression pivotal fastener pivotally coupling the pier compression means to the fifth clevis connector; and q) a cylinder bracket coupling means comprising: (1) a first cylinder bracket pivotal fastener for pivotally coupling the second clevis connector to the cylinder bracket, wherein the first cylinder bracket pivotal fastener has a fastener shaft having a diameter which is 1/32 inch to 1/8 inch smaller than the diameter of the third aperture and (2) a second cylinder bracket pivotal fastener for pivotally coupling the fourth clevis connector to the cylinder bracket, wherein the second cylinder bracket pivotal fastener has a fastener shaft having a diameter which is 1/32 inch to 1/8 inch smaller than the diameter of the seventh aperture, whereby the pier compression means is pivotally linked to the power cylinder yoke.

20. The lifting device according to claim 19 additionally comprising the pier having (1) a predetermined outer profile, (2) a predetermined outer diameter and (3) a predetermined inner diameter, wherein the pier is slidably received by the pier guiding means and wherein the pier is compressibly engaged by the pier compression means, whereby the pier is pivotally linked to the power cylinder yoke.

21. The lifting device according to claim 20 wherein the power cylinder yoke comprises:

a) a first cylinder mounting plate secured to the pier guiding means such that the plane of the first cylinder mounting plate substantially coincides with the longitudinal axis of the pier guiding means, in which the first cylinder mounting plate has an area defining a through-hole having a predetermined diameter for receiving the fastener shaft of the first yoke pivotal fastener wherein the through-hole is spaced a predetermined distance R from the longitudinal axis of the pier guiding means, in which R ranges from about 3 inches to about 12 inches;

b) a second cylinder mounting plate secured to the pier guiding means such that the second cylinder mounting plate is positioned opposite the first cylinder mounting plate and the plane of the second cylinder mounting plate substantially coincides with the longitudinal axis of the pier guiding means, in which the second cylinder mounting plate has an area defining a through-hole having a predetermined diameter for receiving the fastener shaft of the second yoke pivotal fastener wherein the through-hole is spaced a predetermined distance R from the longitudinal axis of the pier guiding means.

22. The lifting device according to the claim 21 wherein the cylinder bracket has (1) a first end having an area defining a through-hole having a predetermined diameter for receiving the fastener shaft of the first cylinder bracket pivotal fastener, (2) a second end having and area defining a through-hole having a predetermined diameter for receiving the fastener shaft of the second cylinder bracket pivotal fastener and (3) a midpoint centrally positioned between the cylinder bracket first end through-hole and second end through-hole, in which the midpoint is positioned a distance R from the cylinder bracket first through-hole and from the cylinder bracket second through-hole, wherein the cylinder bracket midpoint is secured to the first end of the power cylinder.

23. The lifting device according to claim 20 wherein the pier compression means comprises a plug-shaped member having (1) a first end having an area defining a through-hole for receiving the pier compression pivotal fastener, (2) a second end having a predetermined outer diameter which is smaller than the predetermined inner diameter of the pier and (3) an enlarged portion intermediate its first end and its second end having a predetermined diameter which is greater than the inner diameter of the pier.

* * * * *